US008847096B2

(12) United States Patent
Juds et al.

(10) Patent No.: US 8,847,096 B2
(45) Date of Patent: Sep. 30, 2014

(54) SINGLE DIRECT CURRENT ARC CHUTE, AND BI-DIRECTIONAL DIRECT CURRENT ELECTRICAL SWITCHING APPARATUS EMPLOYING THE SAME

(75) Inventors: Mark A. Juds, New Berlin, WI (US); Xin Zhou, Franklin Park, PA (US); Amogh V. Kank, Maharashtra (IN); Paul J. Rollmann, Brown Deer, WI (US); Robert W. Mueller, Aliquippa, PA (US); Michael F. Bartonek, Vienna (AT)

(73) Assignee: Eaton Corporation, Cleveland, OH (US)

( * ) Notice: Subject to any disclaimer, the term of this patent is extended or adjusted under 35 U.S.C. 154(b) by 287 days.

(21) Appl. No.: 13/603,574

(22) Filed: Sep. 5, 2012

(65) Prior Publication Data

US 2014/0061160 A1 Mar. 6, 2014

(51) Int. Cl.
*H01H 9/44* (2006.01)
*H01H 9/36* (2006.01)

(52) U.S. Cl.
CPC . *H01H 9/443* (2013.01); *H01H 9/36* (2013.01)
USPC ..... 218/34; 218/23

(58) Field of Classification Search
CPC ..... H01H 9/44; H01H 9/443; H01H 9/30; H01H 9/34
USPC ..... 218/15, 22–26, 34–41, 148–156; 335/16, 147, 195, 201, 202
See application file for complete search history.

(56) References Cited

U.S. PATENT DOCUMENTS 4,375,021 A 2/1983 Pardini et al.
4,743,720 A 5/1988 Takeuchi et al.

(Continued)

FOREIGN PATENT DOCUMENTS

| | | | |
|---|---|---|---|
| DE | 10 07 409 | B | 5/1957 |
| DE | 967 621 | C | 11/1957 |
| DE | 11 40 997 | B | 12/1962 |
| DE | 12 46 851 | B | 8/1967 |
| DE | 20 2005 007878 | U1 | 9/2006 |
| EP | 2 463 880 | A1 | 6/2012 |

OTHER PUBLICATIONS

European Patent Office, "International Search Report and Written Opinion", Nov. 8, 2013, 9 pp.
Siemens Industry, Inc., "Heavy Duty Photovoltaic Disconnect Switches", www.usa.siemens.com/switches, 2010, 4pp.
Tyco Electronics, "Kilovac EV250-1A & 1B—400 Amps ("Czonka II EVX")", www.tycoelectronics.com, 2010, pp. 16 and 19.

*Primary Examiner* — Amy Cohen Johnson
*Assistant Examiner* — Marina Fishman
(74) *Attorney, Agent, or Firm* — Eckert Seamans Cherin & Mellott, LLC; Kirk D. Houser

(57) ABSTRACT

A direct current arc chute includes a ferromagnetic base having first and second ends; first and second ferromagnetic side members disposed from the respective first and second ends; a third ferromagnetic member disposed from the base intermediate the side members and having an end portion opposite the base; and first and second magnets on the respective first and second members have a magnetic polarity facing the third member. A first arc chamber is between the first and third members; and a second arc chamber is between the second and third members. The first magnet and first member extend away from the first end and beyond the end portion, and toward the second magnet and second member after the end portion. The second magnet and second member extend away from the second end and beyond the end portion, and toward the first magnet and first member after the end portion.

20 Claims, 8 Drawing Sheets

(56) References Cited

U.S. PATENT DOCUMENTS

| | | | | |
|---|---|---|---|---|
| 5,004,874 | A | 4/1991 | Theisen et al. | |
| 5,130,504 | A | 7/1992 | Moldovan et al. | |
| 6,809,282 | B2 * | 10/2004 | Fasano | 218/40 |
| 7,541,902 | B2 | 6/2009 | Domejean et al. | |
| 7,679,020 | B2 | 3/2010 | Schulz et al. | |
| 7,839,243 | B1 | 11/2010 | Chen et al. | |
| 8,222,983 | B2 * | 7/2012 | Zhou et al. | 218/26 |

* cited by examiner

SINGLE DIRECT CURRENT ARC CHUTE, AND BI-DIRECTIONAL DIRECT CURRENT ELECTRICAL SWITCHING APPARATUS EMPLOYING THE SAME

BACKGROUND

1. Field

The disclosed concept pertains generally to electrical switching apparatus and, more particularly, to direct current electrical switching apparatus, such as, for example and without limitation, direct current circuit breakers. The disclosed concept further pertains to direct current arc chutes.

2. Background Information

Electrical switching apparatus employing separable contacts exposed to air can be structured to open a power circuit carrying appreciable current. These electrical switching apparatus, such as, for instance, circuit breakers, typically experience arcing as the contacts separate and commonly incorporate arc chutes to help extinguish the arc. Such arc chutes typically comprise a plurality of electrically conductive plates held in spaced relation around the separable contacts by an electrically insulative housing. The arc transfers to the arc plates where it is stretched and cooled until extinguished.

Typically, molded case circuit breakers (MCCBs) are not specifically designed for use in direct current (DC) applications. When known alternating current (AC) MCCBs are sought to be applied in DC applications, multiple poles are electrically connected in series to achieve the required interruption or switching performance based upon the desired system DC voltage and system DC current.

One of the challenges in DC interruption is to drive the arc into the arc chute, specifically at relatively low current levels. Some known DC switching products use permanent magnets to drive the arc into the arc splitter plates. However, they either provide only uni-directional current interruption, or they are relatively large due to the use of two arc chutes in order to achieve bi-directional performance.

There is room for improvement in direct current electrical switching apparatus.

There is also room for improvement in direct current arc chutes.

SUMMARY

These needs and others are met by embodiments of the disclosed concept.

In accordance with one aspect of the disclosed concept, a direct current arc chute comprises: a ferromagnetic base having a first end and an opposite second end; a first ferromagnetic side member disposed from the first end of the ferromagnetic base; a second ferromagnetic side member disposed from the opposite second end of the ferromagnetic base; a third ferromagnetic member disposed from the ferromagnetic base intermediate the first and second ferromagnetic side members, the third ferromagnetic member having an end portion opposite the ferromagnetic base; a first permanent magnet disposed on the first ferromagnetic side member, the first permanent magnet having a first magnetic polarity facing the third ferromagnetic member; a second permanent magnet disposed on the second ferromagnetic side member, the second permanent magnet having the first magnetic polarity facing the third ferromagnetic member; a first arc chamber disposed between the first ferromagnetic side member and the third ferromagnetic member, the first arc chamber comprising a plurality of arc splitter plates; and a second arc chamber disposed between the second ferromagnetic side member and the third ferromagnetic member, the second arc chamber comprising a plurality of arc splitter plates, wherein the first permanent magnet and the first ferromagnetic side member extend away from the first end of the ferromagnetic base and beyond the end portion of the third ferromagnetic member, wherein the second permanent magnet and the second ferromagnetic side member extend away from the opposite second end of the ferromagnetic base and beyond the end portion of the third ferromagnetic member, wherein the first permanent magnet and the first ferromagnetic side member extend toward the second permanent magnet and the second ferromagnetic side member after the end portion of the third ferromagnetic member, and wherein the second permanent magnet and the second ferromagnetic side member extend toward the first permanent magnet and the first ferromagnetic side member after the end portion of the third ferromagnetic member.

As another aspect of the disclosed concept, a bi-directional, direct current electrical switching apparatus comprises: separable contacts; an operating mechanism structured to open and close the separable contacts; and a single direct current arc chute comprising: a ferromagnetic base having a first end and an opposite second end, a first ferromagnetic side member disposed from the first end of the ferromagnetic base, a second ferromagnetic side member disposed from the opposite second end of the ferromagnetic base, a third ferromagnetic member disposed from the ferromagnetic base intermediate the first and second ferromagnetic side members, the third ferromagnetic member having an end portion opposite the ferromagnetic base, a first permanent magnet disposed on the first ferromagnetic side member, the first permanent magnet having a first magnetic polarity facing the third ferromagnetic member, a second permanent magnet disposed on the second ferromagnetic side member, the second permanent magnet having the first magnetic polarity facing the third ferromagnetic member, a first arc chamber disposed between the first ferromagnetic side member and the third ferromagnetic member, the first arc chamber comprising a plurality of arc splitter plates, and a second arc chamber disposed between the second ferromagnetic side member and the third ferromagnetic member, the second arc chamber comprising a plurality of arc splitter plates, wherein the first permanent magnet and the first ferromagnetic side member extend away from the first end of the ferromagnetic base and beyond the end portion of the third ferromagnetic member, wherein the second permanent magnet and the second ferromagnetic side member extend away from the opposite second end of the ferromagnetic base and beyond the end portion of the third ferromagnetic member, wherein the first permanent magnet and the first ferromagnetic side member extend toward the second permanent magnet and the second ferromagnetic side member after the end portion of the third ferromagnetic member, and wherein the second permanent magnet and the second ferromagnetic side member extend toward the first permanent magnet and the first ferromagnetic side member after the end portion of the third ferromagnetic member.

As another aspect of the disclosed concept, a bi-directional, direct current electrical switching apparatus comprises: separable contacts comprising a movable contact and a fixed contact; an operating mechanism structured to open and close the separable contacts, the operating mechanism comprising a movable contact arm carrying the movable contact; and a single direct current arc chute comprising: a ferromagnetic base having a first end and an opposite second end, a first ferromagnetic side member disposed from the first end of the ferromagnetic base, a second ferromagnetic side member disposed from the opposite second end of the ferromagnetic base, a third ferromagnetic member disposed from the ferromagnetic base intermediate the first and second ferromagnetic side members, the third ferromagnetic member having an end portion opposite the ferromagnetic base, a first permanent magnet disposed on the first ferromagnetic side member, the first permanent magnet having a first magnetic polarity facing the third ferromagnetic member, a second permanent magnet disposed on the second ferromagnetic side member, the second permanent magnet having the first magnetic polarity facing the third ferromagnetic member, a first arc chamber disposed between the first ferromagnetic side member and the third ferromagnetic member, the first arc chamber comprising a plurality of arc splitter plates, a second arc chamber disposed between the second ferromagnetic side member and the third ferromagnetic member, the second arc chamber comprising a plurality of arc splitter plates, a first contoured gassing wall disposed adjacent the first permanent magnet, and a second contoured gassing wall disposed adjacent the second permanent magnet, wherein the first permanent magnet and the first ferromagnetic side member extend away from the first end of the ferromagnetic base and beyond the end portion of the third ferromagnetic member, wherein the second permanent magnet and the second ferromagnetic side member extend away from the opposite second end of the ferromagnetic base and beyond the end portion of the third ferromagnetic member, wherein the movable contact carried by the movable contact arm traces a path of motion between a closed position of the separable contacts and an open position of the separable contacts, and wherein the path of motion is disposed between the end portion of the third ferromagnetic member and the first and second contoured gassing walls.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with direct current circuit breakers, although the disclosed concept is applicable to a wide range of direct current electrical switching apparatus.

Figure 1:
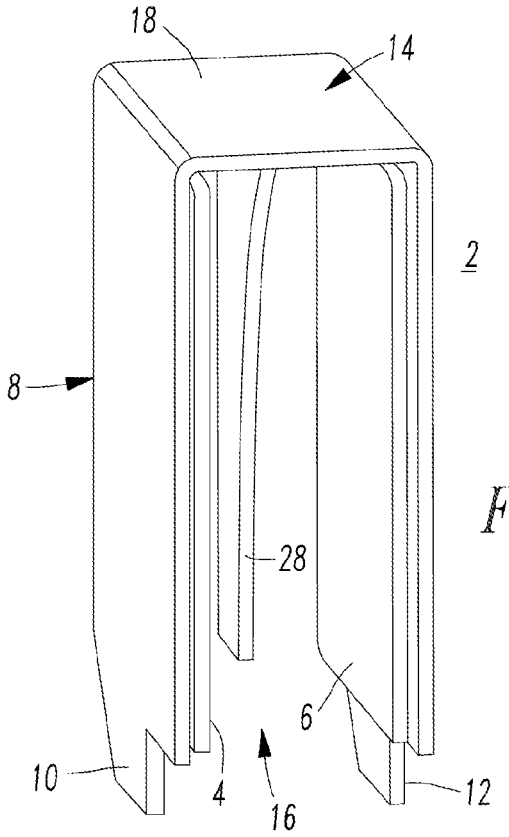
FIG. 1 is an isometric view of a steel and permanent magnet structure including two permanent magnets for a single arc chute.
Figure 2:
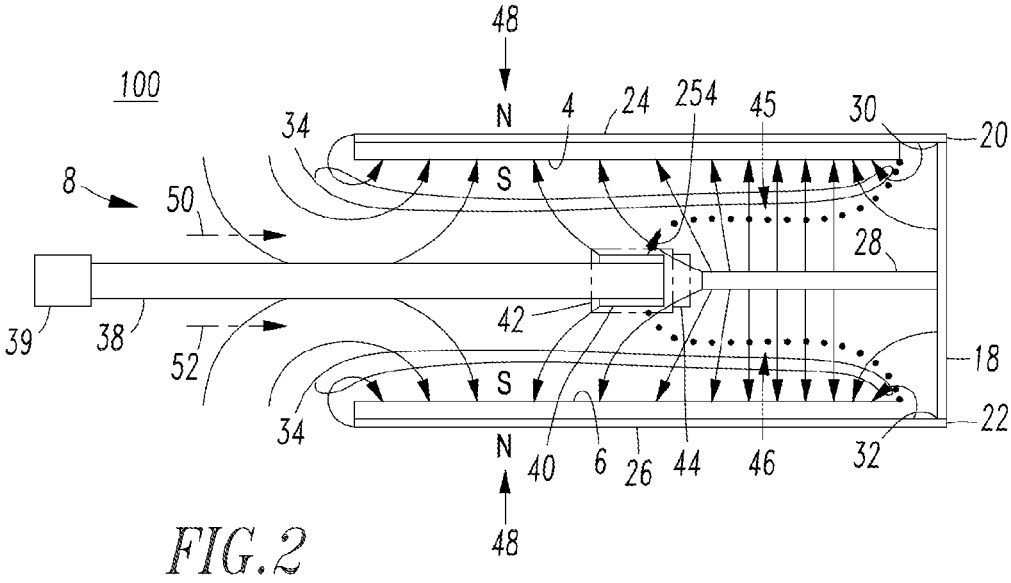
FIG. 2 is a simplified top plan view of the steel and permanent magnet structure of FIG. 1 and also including a movable contact arm and separable contacts in an open position.

Referring to FIGS. 1 and 2, a steel and permanent magnet structure 2 includes two permanent magnets 4,6 for a single direct current arc chute 8. The permanent magnets 4,6 are shown just inside of the two vertical legs 10,12 of a steel structure 14, and are between the steel structure 14 and an insulative housing (not shown). The single direct current arc chute 8 includes a ferromagnetic base 18 having a first end 20 and an opposite second end 22. A first ferromagnetic side member 24 is disposed from the first end 20, a second ferromagnetic side member 26 is disposed from the opposite second end 22, and a third ferromagnetic member 28 is disposed from the ferromagnetic base 18 intermediate the first and second ferromagnetic side members 24,26. The first permanent magnet 4 has a first magnetic polarity (S), is disposed on the first ferromagnetic side member 24 and faces the third ferromagnetic member 28. The second permanent magnet 6 has the first magnetic polarity (S), is disposed on the second ferromagnetic side member 26 and faces the third ferromagnetic member 28.

The first end 20 of the ferromagnetic base 18 and the first ferromagnetic side member 24 disposed from the first end 20 define a first corner 30, and the opposite second end 22 of the ferromagnetic base 18 and the second ferromagnetic side member 26 disposed from the opposite second end 22 define a second corner 32. The single direct current arc chute 8 defines a magnetic field pattern 34. A movable contact arm 38 carries a movable contact 40, which electrically engages a fixed contact 42 carried by a stationary conductor 44. Whenever an arc (not shown) is struck between the movable contact 40 and the fixed contact 42, which are disposed between the first and second ferromagnetic side members 24,26, the magnetic field pattern 34 is structured to drive the arc toward one of the first and second corners 30,32 depending on a direction of current flowing in the arc. For example, for current flowing from the movable contact 40 to the fixed contact 42, the arc is driven toward the corner 30 along path 45. Conversely, for current flowing from the fixed contact 42 to the movable contact 40, the arc is driven toward the corner 32 along path 46.

Unlike FIGS. 1 and 2, the disclosed concept employs an angled permanent magnet side wall as shown in FIGS. 3-7, which is structured to improve the orientation of the magnetic field. This, in turn, drives an arc into arc splitter plates 222, 226. The improved magnetic field orientation forces a magnetic field null point 244 and field reversal away from the two arc chambers 220,224 of the arc chute 200, and increases the magnitude of the magnetic field near the separable contacts 238. The direction of the magnetic field beyond the end of the third ferromagnetic member 212 (between the member 212 and the separable contacts 238) pulls the arc to the first arc chamber 220 or to the second arc chamber 224, depending on the polarity of the electric current. The arc chute 200 employs a permanent magnet arrangement and a single-break contact structure to achieve bi-directional DC switching and interruption capability, including relatively low current levels.

In FIGS. 1 and 2, the magnetic field null point 48 and field reversal are much closer to the separable contacts 42,44 and the arc splitter plates (not shown). During instances when the arc column size is too large at relatively high current levels, the arc could cross the null point 48 and enter the reversed field, which pushes the arc away from the arc splitter plates.

Figure 3:
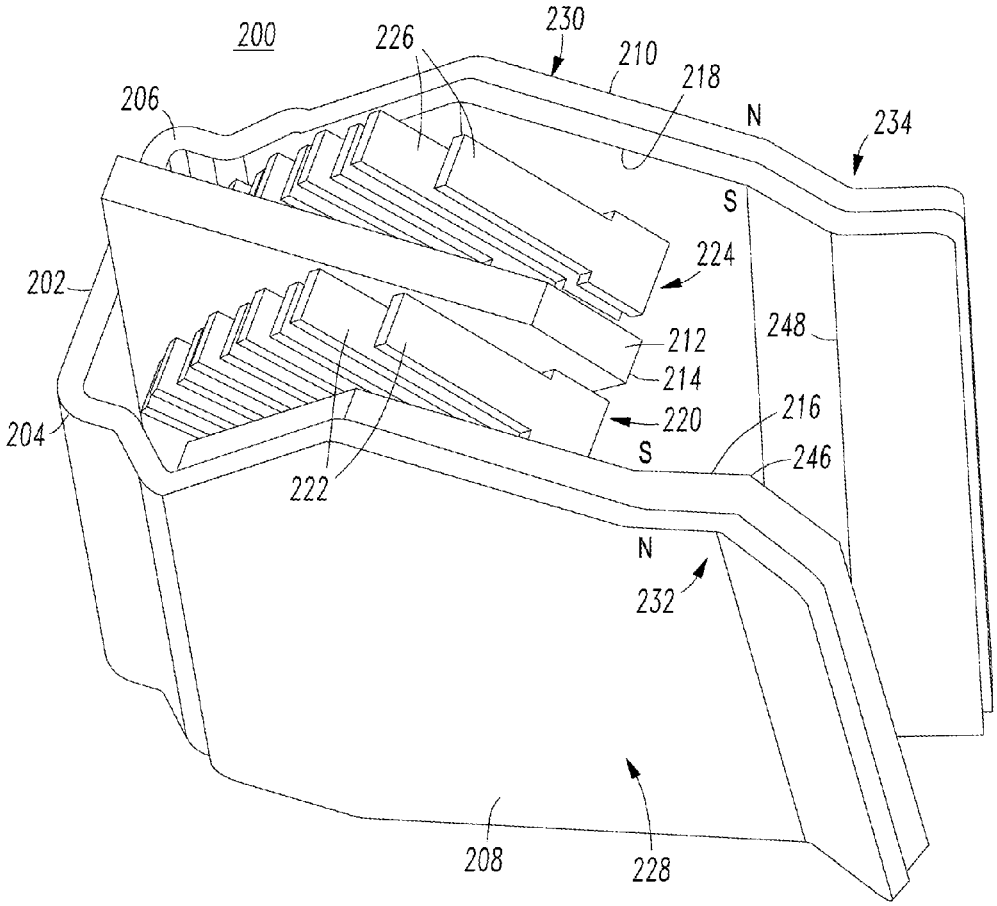
FIG. 3 is an isometric view of a bi-directional arc chute including a steel and permanent magnet structure having two permanent magnets in accordance with embodiments of the disclosed concept.
Figure 4:
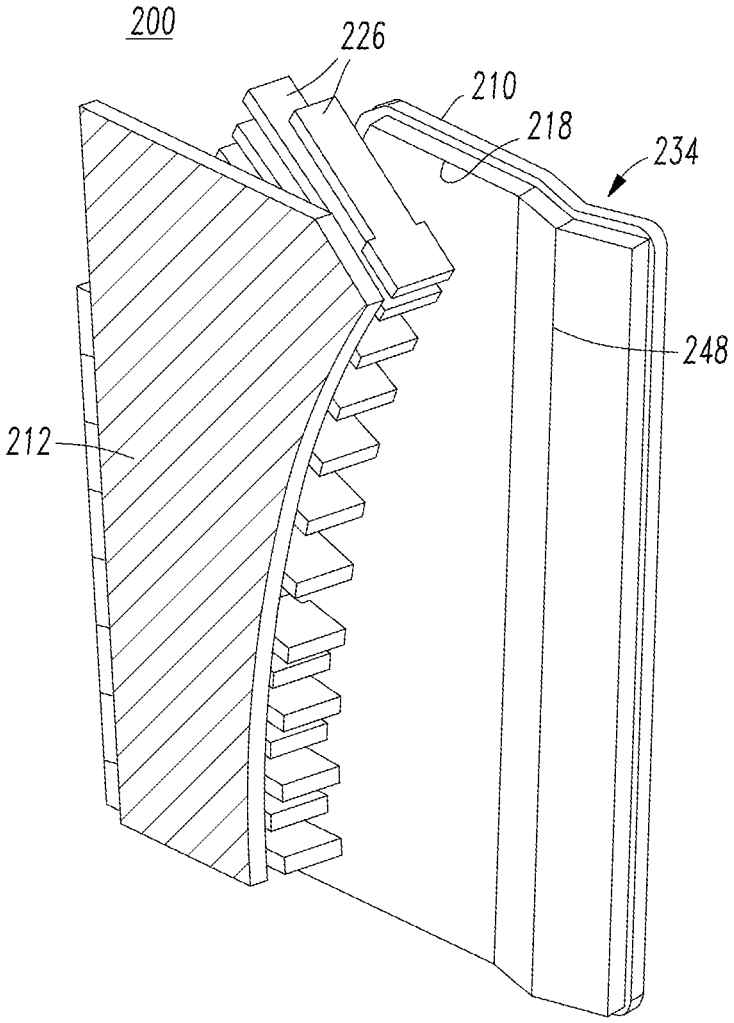
FIG. 4 is an isometric view of one-half of the bi-directional arc chute of FIG. 3.
Figure 5:
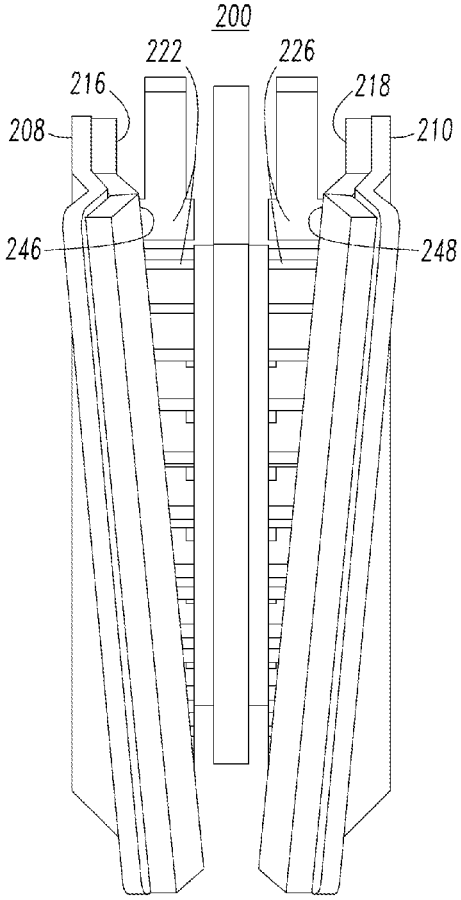
FIGS. 5 and 6 are end vertical elevation isometric views of the bi-directional arc chute of FIG. 3.
Figure 6:
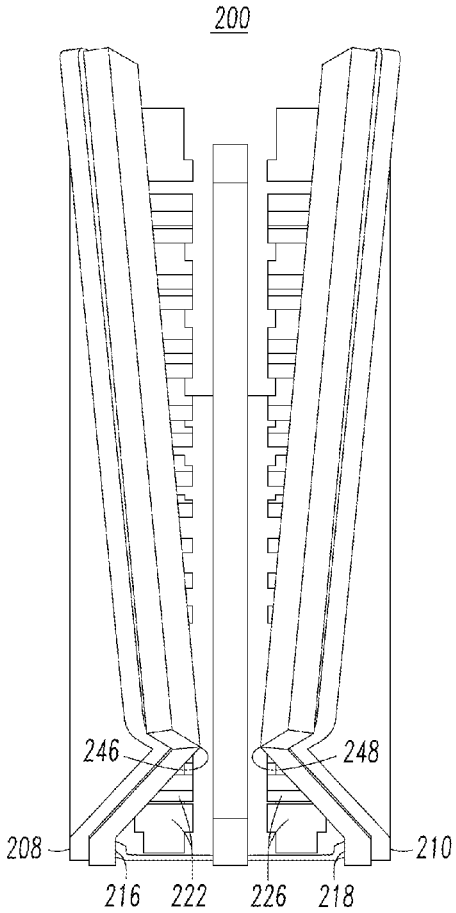
Figure 7:
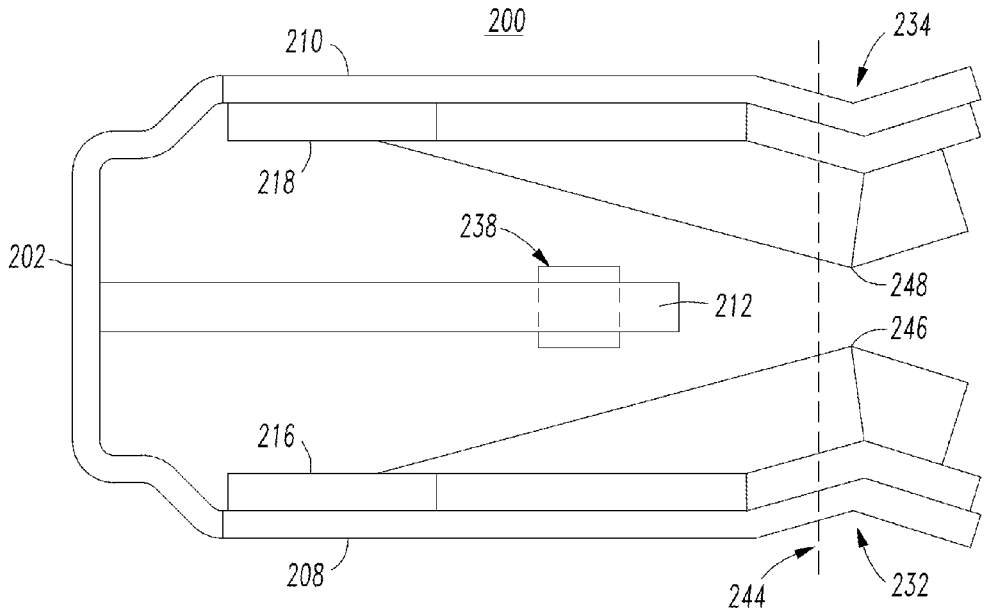
FIG. 7 is a top plan view of the bi-directional arc chute of FIG. 3.

FIG. 3 shows the bi-directional direct current arc chute 200. The direct current arc chute 200 includes a ferromagnetic base 202 having a first end 204 and an opposite second end 206, a first ferromagnetic side member 208 disposed from the first end 204, a second ferromagnetic side member 210 disposed from the opposite second end 206, and the third ferromagnetic member 212 disposed from the ferromagnetic base 202 intermediate the first and second ferromagnetic side members 208,210. The third ferromagnetic member 212 has an end portion 214 opposite the ferromagnetic base 202. A first permanent magnet 216 is disposed on the first ferromagnetic side member 208 and has a first magnetic polarity (S) facing the third ferromagnetic member 212. A second permanent magnet 218 is disposed on the second ferromagnetic side member 210 and has the first magnetic polarity (S) facing the third ferromagnetic member 212. The first arc chamber 220 is disposed between the first ferromagnetic side member 208 and the third ferromagnetic member 212. The first arc chamber 220 includes the plurality of arc splitter plates 222. The second arc chamber 224 is disposed between the second ferromagnetic side member 210 and the third ferromagnetic member 212. The second arc chamber 224 includes the plurality of arc splitter plates 226. The first permanent magnet 216 and the first ferromagnetic side member 208 extend away from the first end 204 of the ferromagnetic base 202 and beyond the end portion 214 of the third ferromagnetic member 212. The second permanent magnet 218 and the second ferromagnetic side member 210 extend away from the opposite second end 206 of the ferromagnetic base 202 and beyond the end portion 214 of the third ferromagnetic member 212. The first permanent magnet 216 and the first ferromagnetic side member 208 extend toward the second permanent magnet 218 and the second ferromagnetic side member 210 after the end portion 214 of the third ferromagnetic member 212. The second permanent magnet 218 and the second ferromagnetic side member 210 extend toward the first permanent magnet 216 and the first ferromagnetic side member 208 after the end portion 214 of the third ferromagnetic member 212.

The arc chute 200 of FIG. 3 employs extended and angled ferromagnetic side members 208,210 and permanent magnets 216,218 along both sides 228,230, respectively, of the arc chute 200, which provides a dual arc chamber structure 220, 224 with a ferromagnetic center barrier formed by the third ferromagnetic member 212.

The angled permanent magnet and ferromagnetic side member side wall structure of the arc chute 200 improves the orientation of the magnetic field which drives the arc into one of the dual arc chambers 220,224 (depending on the current direction) and splits the arc. As shown in FIGS. 3-7, the bottoms of the example V-shapes 232,234 of the angled permanent magnet and ferromagnetic side member side wall structures point toward each other.

As contrasted with the magnetic field pattern 34 of FIG. 2, in which the magnetic field null point 48 and field reversal are relatively close to the movable contact 40 and the fixed contact 42, for the structure of the arc chute 200 of FIGS. 3-7, the magnetic field null point 244 and field reversal are moved relatively far to the right (with respect to FIG. 7) of separable contacts 238 (shown in FIG. 8), and the magnitude of the magnetic field is increased near the separable contacts 238. As shown in FIG. 2, the magnetic field at the magnetic field null point 48 is zero. Moving the magnetic field null point away from the separable contacts 238 results in a relatively larger magnetic field at the location of the separable contacts 238.

The advantage of this movement of the magnetic field null point and the line of magnetic field reversal is as follows. An arc forms between the separable contacts 238 (shown in FIG. 8) when they initially part. It is desired to move the arc to the right or to the left (with respect to FIGS. 5 and 6) and into the respective right or left (with respect to FIGS. 5 and 6) splitter plates 226,222, depending on the direction of current flow in the arc. If the magnetic field is relatively large, then the arc will more quickly (and more reliably) move off of the separable contacts 238 and into the arc splitter plates 222,226 and be extinguished (in order to interrupt the current). When the arc can be extinguished and interrupt the current relatively more quickly, then there is less damage to the separable contacts 238 and the arc splitter plates 222,226 per interruption, and the life of a corresponding electrical switching apparatus, such as circuit breaker 240 (FIG. 8), is extended.

Example 1

The following factors can increase the magnitude of the magnetic field near the fixed contact 242 (shown in FIG. 8): (1) increasing the thickness of the permanent magnets 216, 218; (2) increasing the strength of the material of the permanent magnets 216,218, although relatively stronger magnetic materials are generally susceptible to demagnetization at relatively lower temperatures; (3) decreasing the distance between the separable contacts 238 (shown in FIG. 8) and the intermediate ferromagnetic (e.g., without limitation, steel) member 212; and (4) increasing the distance between the separable contacts 238 and the magnetic field null point 244 (shown in FIG. 7).

Example 2

The first permanent magnet 216 and the first ferromagnetic side member 208 are parallel with the second permanent magnet 218 and the second ferromagnetic side member 210 between the first end 204 of the ferromagnetic base 202 and the end portion 214 of the third ferromagnetic member 212. The second permanent magnet 218 and the second ferromagnetic side member 210 are parallel with the first permanent magnet 216 and the first ferromagnetic side member 208 between the opposite second end 206 of the ferromagnetic base 202 and the end portion 214 of the third ferromagnetic member 212.

Example 3

The first permanent magnet 216 and the first ferromagnetic side member 208 both angle toward the second permanent magnet 218 and the second ferromagnetic side member 210 after the end portion 214 of the third ferromagnetic member 212. The second permanent magnet 218 and the second ferromagnetic side member 210 both angle toward the first permanent magnet 216 and the first ferromagnetic side member 208 after the end portion 214 of the third ferromagnetic member 212. This allows the magnetic field to pull the arc toward the desired arc splitter plates 222 or 226 regardless of the initial arc motion direction. The direction of the magnetic field beyond the end portion 214 of the third ferromagnetic member 212 (between the member 212 and the separable contacts 238 (FIG. 8)) pulls the arc to the first arc chute 220 or to the second arc chute 224, depending on the polarity of the electric current.

Example 4

The permanent magnets 216,218, ferromagnetic side members 208,210, and ferromagnetic center barrier formed by ferromagnetic member 212 are preferably covered with electrical insulation (not shown) to prevent shorting out of the arc column. The arc chute 200 is divided into the two arc chambers 220,224 with separate arc splitter plates 222,226.

Example 5

The permanent magnets 216,218 are made of a shaped polymer-filled magnetic material.

Example 6

The first permanent magnet 216 and the first ferromagnetic side member 208 both form the first V-shape 232 having a first crest portion 246 facing the second permanent magnet 218 and the second ferromagnetic side member 210. The second permanent magnet 218 and the second ferromagnetic side member 210 both form the second V-shape 234 having a second crest portion 248 facing the first permanent magnet 216 and the first ferromagnetic side member 208. The first crest portion 246 is proximate the second crest portion 248.

Example 7

The crest portions 246,248 are proximate movable contact arm 250 (FIG. 8) and proximate a movable contact 252 (FIG. 8) between the movable contact 252 and a pivot point 254 (FIG. 8) of the movable contact arm 250. The V-shapes 232, 234 form an example straight line (best shown in FIGS. 3, 4 and 7) for ease of manufacture, and are preferably as close as possible to the movable contact arm 250 and to the movable contact 252 while staying between the movable contact 252 and the pivot point 254.

Example 8

The permanent magnets 216,218 are suitably shaped (e.g., without limitation, with a polymer-filled magnetic material). Another positive effect of such a design can be the influence of the cross-section-reduction "behind" (to the right with respect to FIG. 7) the arc to drive the arc forward (to the left with respect to FIG. 7) as a result of fluid dynamics. The example cross section reduction crest portions 246,248 "behind" (to the right with respect to FIG. 7) the separable contacts 238 (FIG. 8) increases the magnetic field at the location of the separable contacts 238, improves the orientation of the magnetic field "behind" the separable contacts 238, and moves the magnetic null further "behind" the separable contacts 238. This cross section reduction also makes it relatively more difficult for arc gasses to flow in the direction toward the crest portions 246,248.

Example 9

Figure 8:
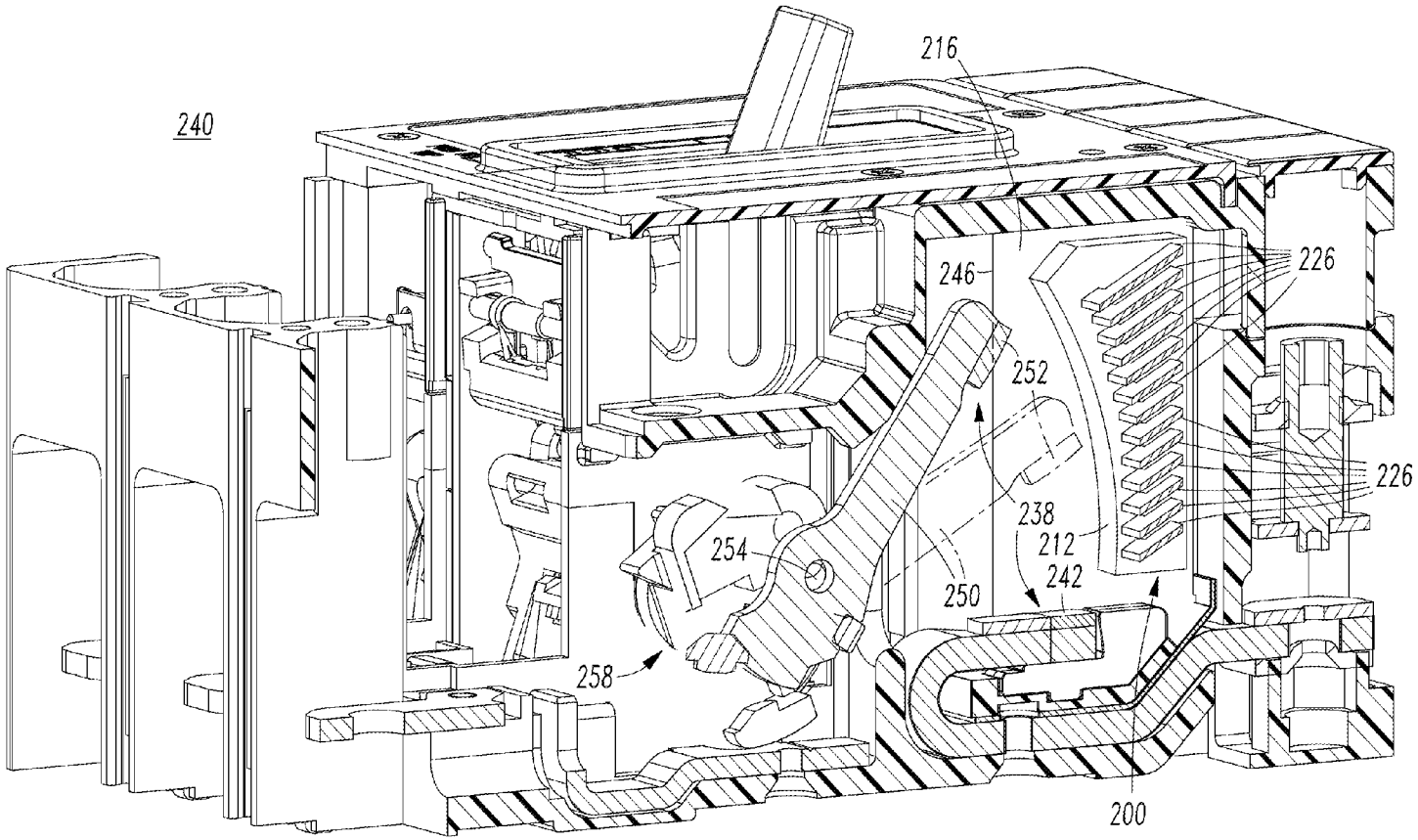
FIG. 8 is an isometric view of an electrical switching apparatus with some parts cut away to show internal structures in an open position in accordance with embodiments of the disclosed concept.

FIG. 8 shows a bi-directional, direct current electrical switching apparatus, such as the example circuit breaker 240, which includes the separable contacts 238 in an open position, an operating mechanism 258 structured to open and close the separable contacts 238, and the single direct current arc chute 200 of FIG. 3. The separable contacts 238 include the fixed contact 242 and the movable contact 252 carried by the movable contact arm 250. The operating mechanism 258 includes the movable contact arm 250 carrying the movable contact 252 with respect to the single direct current arc chute 200.

Example 10

The movable contact 252 carried by the movable contact arm 250 traces an entire path of motion between the closed position (not shown, although a position intermediate the open and closed positions is shown in phantom line drawing) of the separable contacts 238 and the open position (as shown in FIG. 8) of the separable contacts 238. The V-shapes 232, 234 (FIGS. 3-6) form a straight line for ease of manufacture and are preferably as close as possible to the movable contact arm 250 and to the movable contact 252 while staying between the movable contact 252 and the pivot point 254 of the movable contact arm 250.

Example 11

An arc forms between the fixed contact 242 and the movable contact 252 when the separable contacts 238 move from the closed position toward the open position of the separable contacts 238. The arc is disposed between the end portion 214 of the third ferromagnetic member 212 and the first and second crest portions 246,248, and is driven toward one of the first and second arc chambers 220,224.

Example 12

The first permanent magnet 216 and the first ferromagnetic side member 208 both angle toward the second permanent magnet 218 and the second ferromagnetic side member 210 after the end portion 214 of the third ferromagnetic member 212 along a portion of the path of motion of the movable contact 252. The second permanent magnet 218 and the second ferromagnetic side member 210 both angle toward the first permanent magnet 216 and the first ferromagnetic side member 208 after the end portion 214 of the third ferromagnetic member 212 along the portion of the movable contact path of motion.

Example 13

The first V-shape 232 has the first crest portion 246 along a portion of the movable contact path of motion, and the second V-shape 234 has the second crest portion 248 along the portion of the movable contact path of motion.

Figure 9:
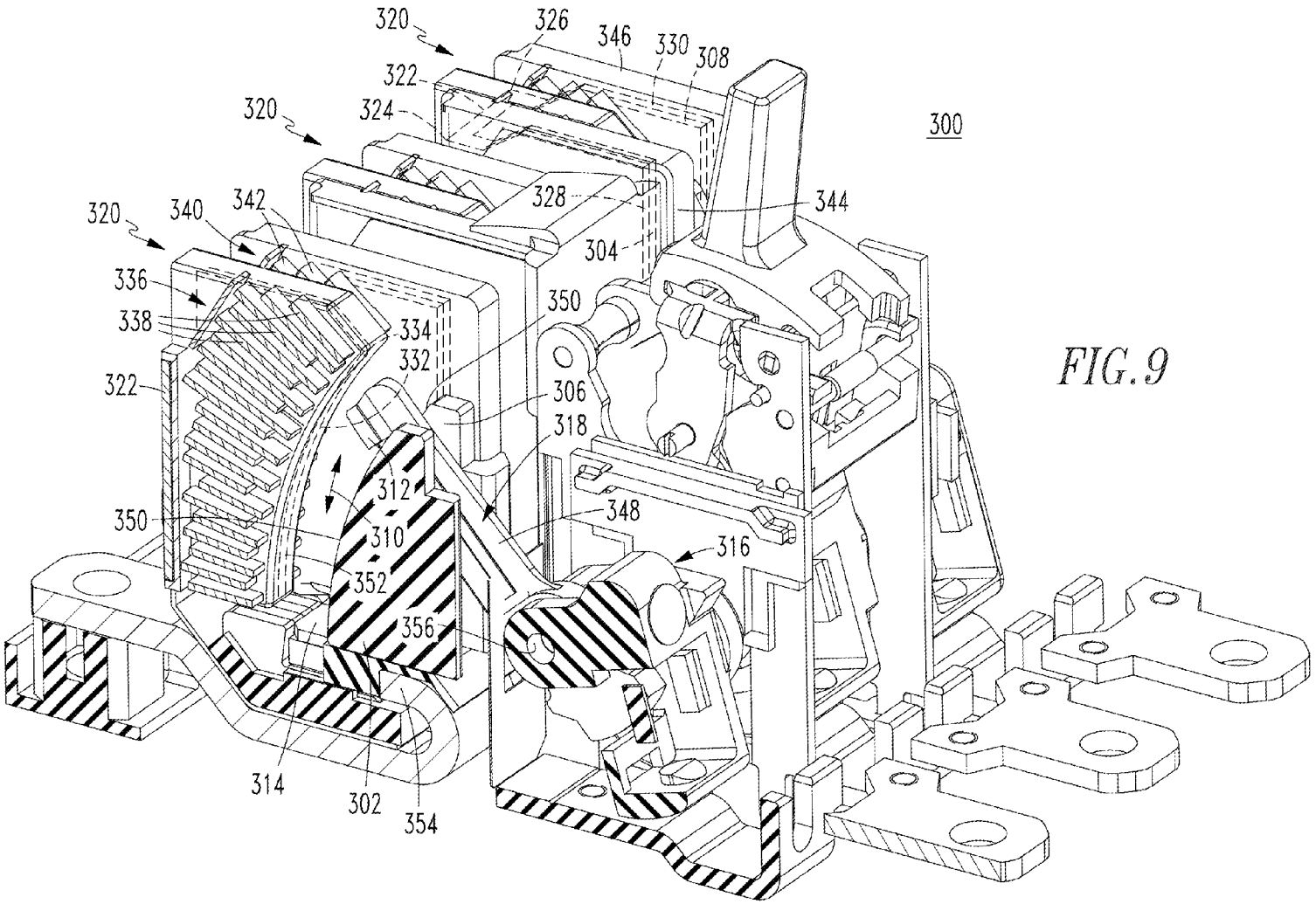
FIG. 9 is an isometric view of an electrical switching apparatus with some parts cut away to show internal structures in an open position in accordance with other embodiments of the disclosed concept.

FIG. 9 shows another bi-directional, direct current electrical switching apparatus, such as an example circuit breaker 300, in an open position. The circuit breaker 300 can be similar to the electrical switching apparatus 100 of FIG. 2, except that it includes a first contoured gassing wall 302 disposed adjacent a first permanent magnet 304, and a second contoured gassing wall 306 disposed adjacent a second permanent magnet 308. Similar to the electrical switching apparatus 100 of FIG. 2, the circuit breaker 300 includes separable contacts 310 having a movable contact 312 and a fixed contact 314, and an operating mechanism 316 structured to open (shown in FIG. 9) and close (not shown) the separable contacts 310. The operating mechanism 316 includes a movable contact arm 318 carrying the movable contact 312.

Somewhat similar to the direct current arc chute 8 of FIGS. 1 and 2, a single direct current arc chute 320 includes a ferromagnetic base 322 having a first end 324 and an opposite second end 326, a first ferromagnetic side member 328 disposed from the first end 324, a second ferromagnetic side member 330 disposed from the opposite second end 326, and a third ferromagnetic member 332 disposed from the ferromagnetic base 322 intermediate the first and second ferromagnetic side members 328,330. The third ferromagnetic member 332 has an end portion 334 opposite the ferromagnetic base 322. The first permanent magnet 304 is disposed on the first ferromagnetic side member 328 and has a first magnetic polarity facing the third ferromagnetic member 332. The second permanent magnet 308 is disposed on the second ferromagnetic side member 330 and has the first magnetic polarity facing the third ferromagnetic member 332. A first arc chamber 336 is disposed between the first ferromagnetic side member 328 and the third ferromagnetic member 332 and includes a plurality of arc splitter plates 338. A second arc chamber 340 is disposed between the second ferromagnetic side member 330 and the third ferromagnetic member 332 and includes a plurality of arc splitter plates 342. The first permanent magnet 304 and the first ferromagnetic side member 328 extend away from the first end 324 of the ferromagnetic base 322 and beyond the end portion 334 of the third ferromagnetic member 332. The second permanent magnet 308 and the second ferromagnetic side member 330 extend away from the opposite second end 326 of the ferromagnetic base 322 and beyond the end portion 334 of the third ferromagnetic member 332.

However, in contrast to the direct current arc chute 8 of FIGS. 1 and 2, the first contoured gassing wall 302 is disposed adjacent the first permanent magnet 304, and the second contoured gassing wall 306 is disposed adjacent the second permanent magnet 308. The movable contact 312 carried by the movable contact arm 318 traces a path of motion between the closed position (not shown) of the separable contacts 310 and the open position (shown in FIG. 9) of the separable contacts 310, and the path of motion is disposed between the end portion 334 of the third ferromagnetic member 332 and the first and second contoured gassing walls 302,306.

Figure 10:
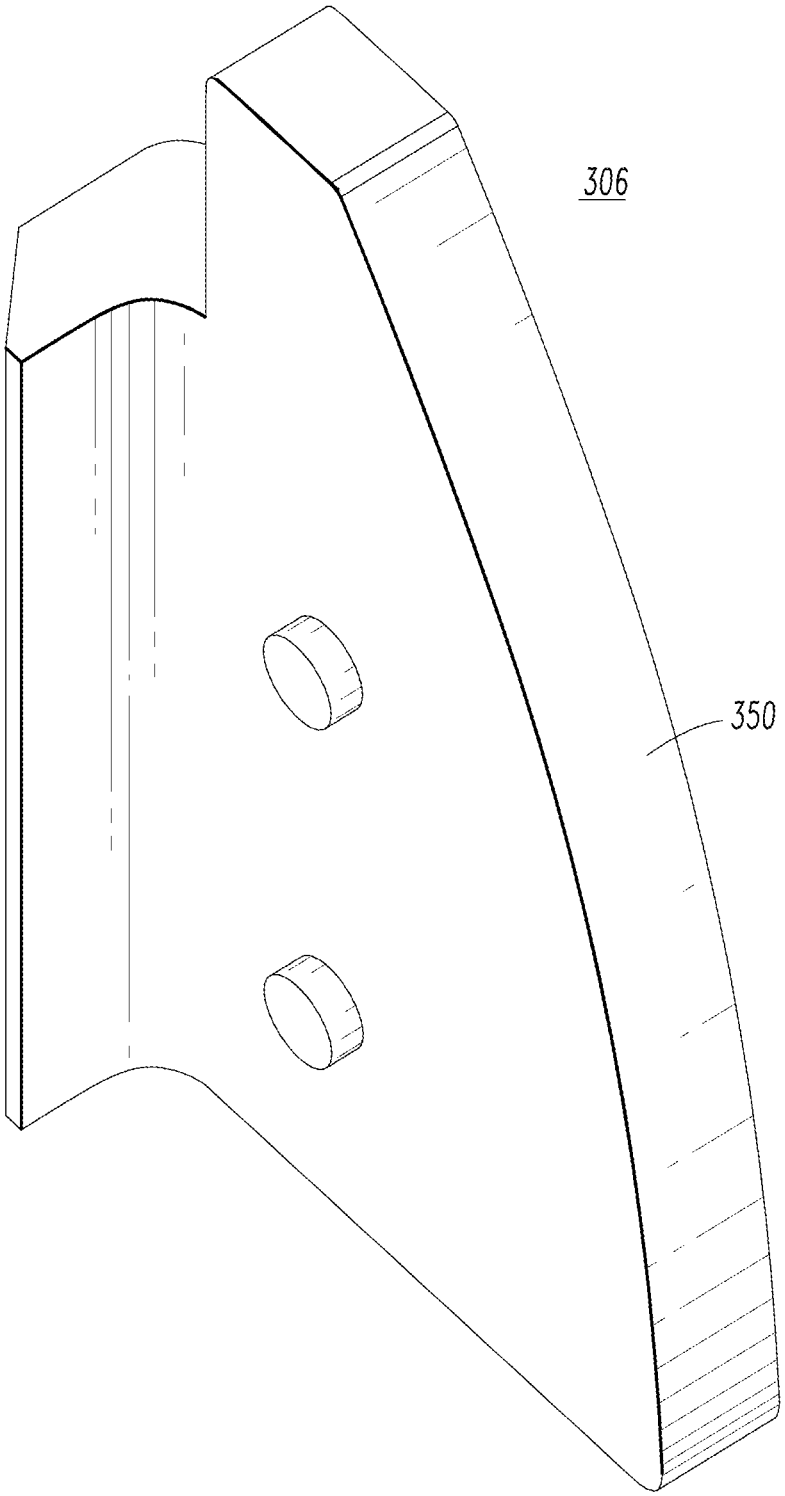
FIG. 10 is an isometric view of one of the gassing inserts of FIG. 9.

FIG. 10 shows one 306 of the first and second contoured gassing walls 302,306 of FIG. 9. The other contoured gassing wall 302 is a mirror image of the wall 306. The addition of gassing materials "behind" (e.g., to the right with respect to FIG. 9) the separable contacts 310 causes an additional flow of gas toward the single direct current arc chute 320 to help drive the arc thereto.

Example 14

Preferably, a first insulating casing or insulator 344 is disposed about the first permanent magnet 304, and a second insulating casing or insulator 346 is disposed about the second permanent magnet 308.

Example 15

The first contoured gassing wall 302 is coupled to the first insulating casing or insulator 344 about the first permanent magnet 304, and the second contoured gassing wall 306 is coupled to the second insulating casing or insulator 346 about the second permanent magnet 308. These contoured gassing walls 302,306 improve the bi-directional switching and interruption capability at relatively high current levels by driving the arc into one of the two arc splitter plates 338 or 342. These also block the arc from entering into the reversed magnetic field and achieve bi-directional DC switching and interruption capability, including relatively high direct current levels.

Example 16

A magnetic field between the first and second permanent magnets 304,308 reverses direction at a volume of space distal from the first and second arc chambers 336,340, beyond the end portion 334 of the third ferromagnetic member 332 and beyond the closed position of the separable contacts 310. The first and second contoured gassing walls 302,306 are structured to block such volume of space. Otherwise, the reversed magnetic field would push the arc away from the arc splitter plates 338 or 342.

Example 17

The movable contact arm 318 includes an insulating casing or insulator 348 disposed thereabout.

Example 18

Each of the first and second contoured gassing walls 302, 306 has a curved portion 350 that approximates the path of motion of the movable contact 312.

Example 19

The end portion 334 of the third ferromagnetic member 332 also has a curved portion 352 that approximates the path of motion of the movable contact 312.

Example 20

As was discussed above in connection with FIGS. 1 and 2, the direct current arc chute 8 generates a magnetic field containing a null point 48 and a field reversal which are relatively close to the back end of the two arc chambers 50,52 adjacent to the pivot point 39 of the movable contact arm 38.

As shown in FIG. 9, during infrequent instances when an arc (not shown) initially moves away from the arc splitter plates 338,342 at relatively high current levels, the arc is large enough to cross the null point 48 (shown in FIG. 2) and enter the reversed field, which pushes the arc away from the arc splitter plates 338,342. The disclosed contoured gassing walls 302,306 block the arc from entering into the reversed magnetic field to achieve bi-directional DC switching and interruption capability at relatively high current levels. The addition of gassing materials "behind" the separable contacts 310 causes an additional flow of gas toward the arc chute 320 to help drive the arc toward the arc chute 320.

Example 21

The two example gassing walls 302,306 are added to the magnet insulators 344,346 and block the volume where the magnetic field reverses its direction and otherwise would push the arc away from the arc splitter plates 338,342. Alternatively, the two gassing walls 302,306 can be an integrated part of the magnet insulators 344,346. These support the arc quenching at a sufficient level of current without affecting the magnetic field.

The magnet insulators 344,346 are preferably employed to prevent possible breakdown or back striking during switching and interruption.

Both the entire movable contact arm 318 and the entire stationary conductor 354 are preferably insulated. This prevents formation of an arc "behind" (e.g., to the right with respect to FIG. 9 and toward the pivot point 356 of the movable contact arm 318) the separable contacts 310. An arc can form "behind" the separable contacts 310 due to ionized gas from the initial arc, where the gap between the movable contact arm 318 and the stationary conductor 354 is relatively small.

Example 22

The gassing walls 302,306 out-gas and move the arc toward the arc splitter plates 338,342. In contrast, in FIGS. 1 and 2, the magnetic field near the magnetic field null point 48 is not large enough to reliably move the arc (not shown) toward the splitter plates (not shown) every time. The outgassing of the gassing walls 302,306 produces a gas pressure that prevents the arc from moving away from the arc splitter plates 338,342 (toward the magnetic null point), and it also helps to move the arc towards the arc splitter plates 338,342.

Example 23

Preferably, the gassing walls 302,306 are gassing inserts, which are as large as possible behind the path of the movable contact 312.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A direct current arc chute comprising:

a ferromagnetic base having a first end and an opposite second end;

a first ferromagnetic side member disposed from the first end of the ferromagnetic base;

a second ferromagnetic side member disposed from the opposite second end of the ferromagnetic base;

a third ferromagnetic member disposed from the ferromagnetic base intermediate the first and second ferromagnetic side members, said third ferromagnetic member having an end portion opposite the ferromagnetic base;

a first permanent magnet disposed on the first ferromagnetic side member, said first permanent magnet having a first magnetic polarity facing the third ferromagnetic member;

a second permanent magnet disposed on the second ferromagnetic side member, said second permanent magnet having the first magnetic polarity facing the third ferromagnetic member;

a first arc chamber disposed between said first ferromagnetic side member and said third ferromagnetic member, said first arc chamber comprising a plurality of arc splitter plates; and a second arc chamber disposed between said second ferromagnetic side member and said third ferromagnetic member, said second arc chamber comprising a plurality of arc splitter plates, wherein said first permanent magnet and said first ferromagnetic side member extend away from the first end of the ferromagnetic base and beyond the end portion of said third ferromagnetic member, wherein said second permanent magnet and said second ferromagnetic side member extend away from the opposite second end of the ferromagnetic base and beyond the end portion of said third ferromagnetic member, wherein said first permanent magnet and said first ferromagnetic side member extend toward said second permanent magnet and said second ferromagnetic side member after the end portion of said third ferromagnetic member, and wherein said second permanent magnet and said second ferromagnetic side member extend toward said first permanent magnet and said first ferromagnetic side member after the end portion of said third ferromagnetic member.

2. The direct current arc chute of claim 1 wherein said first permanent magnet and said first ferromagnetic side member are parallel with said second permanent magnet and said second ferromagnetic side member between the first end of the ferromagnetic base and the end portion of said third ferromagnetic member; and wherein said second permanent magnet and said second ferromagnetic side member are parallel with said first permanent magnet and said first ferromagnetic side member between the opposite second end of the ferromagnetic base and the end portion of said third ferromagnetic member.

3. The direct current arc chute of claim 2 wherein said first permanent magnet and said first ferromagnetic side member both angle toward said second permanent magnet and said second ferromagnetic side member after the end portion of said third ferromagnetic member, and wherein said second permanent magnet and said second ferromagnetic side member both angle toward said first permanent magnet and said first ferromagnetic side member after the end portion of said third ferromagnetic member.

4. The direct current arc chute of claim 1 wherein said first permanent magnet, said second permanent magnet, said first ferromagnetic side member, said second ferromagnetic side member and said third ferromagnetic member are covered with electrical insulation.

5. The direct current arc chute of claim 1 wherein said first permanent magnet and said second permanent magnet are made of a shaped polymer-filled magnetic material.

6. The direct current arc chute of claim 1 wherein said first permanent magnet and said first ferromagnetic side member both form a first V-shape having a first crest portion facing said second permanent magnet and said second ferromagnetic side member; wherein said second permanent magnet and said second ferromagnetic side member both form a second V-shape having a second crest portion facing said first permanent magnet and said first ferromagnetic side member; and wherein the first crest portion is proximate the second crest portion.

7. A bi-directional, direct current electrical switching apparatus comprising:

separable contacts;

an operating mechanism structured to open and close said separable contacts; and a single direct current arc chute comprising:

a ferromagnetic base having a first end and an opposite second end, a first ferromagnetic side member disposed from the first end of the ferromagnetic base, a second ferromagnetic side member disposed from the opposite second end of the ferromagnetic base, a third ferromagnetic member disposed from the ferromagnetic base intermediate the first and second ferromagnetic side members, said third ferromagnetic member having an end portion opposite the ferromagnetic base, a first permanent magnet disposed on the first ferromagnetic side member, said first permanent magnet having a first magnetic polarity facing the third ferromagnetic member, a second permanent magnet disposed on the second ferromagnetic side member, said second permanent magnet having the first magnetic polarity facing the third ferromagnetic member, a first arc chamber disposed between said first ferromagnetic side member and said third ferromagnetic member, said first arc chamber comprising a plurality of arc splitter plates, and a second arc chamber disposed between said second ferromagnetic side member and said third ferromagnetic member, said second arc chamber comprising a plurality of arc splitter plates, wherein said first permanent magnet and said first ferromagnetic side member extend away from the first end of the ferromagnetic base and beyond the end portion of said third ferromagnetic member, wherein said second permanent magnet and said second ferromagnetic side member extend away from the opposite second end of the ferromagnetic base and beyond the end portion of said third ferromagnetic member, wherein said first permanent magnet and said first ferromagnetic side member extend toward said second permanent magnet and said second ferromagnetic side member after the end portion of said third ferromagnetic member, and wherein said second permanent magnet and said second ferromagnetic side member extend toward said first permanent magnet and said first ferromagnetic side member after the end portion of said third ferromagnetic member.

8. The bi-directional, direct current electrical switching apparatus of claim 7 wherein said separable contacts comprise a movable contact and a fixed contact; and wherein said operating mechanism comprises a movable contact arm carrying said movable contact with respect to said single direct current arc chute.

9. The bi-directional, direct current electrical switching apparatus of claim 8 wherein said first permanent magnet and said first ferromagnetic side member both form a first V-shape having a first crest portion facing said second permanent magnet and said second ferromagnetic side member; wherein said second permanent magnet and said second ferromagnetic side member both form a second V-shape having a second crest portion facing said first permanent magnet and said first ferromagnetic side member; and wherein the first crest portion is proximate the second crest portion.

10. The bi-directional, direct current electrical switching apparatus of claim 8 wherein said first permanent magnet and said first ferromagnetic side member both form a first crest portion facing said second permanent magnet and said second ferromagnetic side member; wherein said second permanent magnet and said second ferromagnetic side member both form a second crest portion facing said first permanent magnet and said first ferromagnetic side member; and wherein said first crest portion and said second crest portion are proximate the movable contact arm and proximate the movable contact between the movable contact and a pivot point of the movable contact arm.

11. The bi-directional, direct current electrical switching apparatus of claim 10 wherein an arc forms between said fixed contact and said movable contact when said separable contacts move from the closed position of said separable contacts toward the open position of said separable contacts; and wherein said arc is disposed between the end portion of said third ferromagnetic member and the first and second crest portions, and is driven toward one of said first and second arc chambers.

12. The bi-directional, direct current electrical switching apparatus of claim 7 wherein said separable contacts comprise a movable contact and a fixed contact; wherein said operating mechanism comprises a movable contact arm carrying said movable contact with respect to said single direct current arc chute in a path of motion between a first position in which said movable contact and said fixed contact are closed and a second position in which said movable contact and said fixed contact are open; wherein said first permanent magnet and said first ferromagnetic side member both angle toward said second permanent magnet and said second ferromagnetic side member after the end portion of said third ferromagnetic member along a portion of said path of motion; and wherein said second permanent magnet and said second ferromagnetic side member both angle toward said first permanent magnet and said first ferromagnetic side member after the end portion of said third ferromagnetic member along the portion of said path of motion.

13. The bi-directional, direct current electrical switching apparatus of claim 12 wherein said first permanent magnet and said first ferromagnetic side member both form a first V-shape having a first crest along the portion of said path of motion; wherein said second permanent magnet and said second ferromagnetic side member both form a second V-shape having a second crest along the portion of said path of motion; and wherein the first crest is proximate the second crest.

14. A bi-directional, direct current electrical switching apparatus comprising:

separable contacts comprising a movable contact and a fixed contact;

an operating mechanism structured to open and close said separable contacts, said operating mechanism comprising a movable contact arm carrying said movable contact; and a single direct current arc chute comprising:

a ferromagnetic base having a first end and an opposite second end, a first ferromagnetic side member disposed from the first end of the ferromagnetic base, a second ferromagnetic side member disposed from the opposite second end of the ferromagnetic base, a third ferromagnetic member disposed from the ferromagnetic base intermediate the first and second ferromagnetic side members, said third ferromagnetic member having an end portion opposite the ferromagnetic base, a first permanent magnet disposed on the first ferromagnetic side member, said first permanent magnet having a first magnetic polarity facing the third ferromagnetic member, a second permanent magnet disposed on the second ferromagnetic side member, said second permanent magnet having the first magnetic polarity facing the third ferromagnetic member, a first arc chamber disposed between said first ferromagnetic side member and said third ferromagnetic member, said first arc chamber comprising a plurality of arc splitter plates, a second arc chamber disposed between said second ferromagnetic side member and said third ferromagnetic member, said second arc chamber comprising a plurality of arc splitter plates, a first contoured gassing wall disposed adjacent said first permanent magnet, and a second contoured gassing wall disposed adjacent said second permanent magnet, wherein said first permanent magnet and said first ferromagnetic side member extend away from the first end of the ferromagnetic base and beyond the end portion of said third ferromagnetic member, wherein said second permanent magnet and said second ferromagnetic side member extend away from the opposite second end of the ferromagnetic base and beyond the end portion of said third ferromagnetic member, wherein the movable contact carried by the movable contact arm traces a path of motion between a closed position of said separable contacts and an open position of said separable contacts, and wherein the path of motion is disposed between the end portion of said third ferromagnetic member and the first and second contoured gassing walls.

15. The bi-directional, direct current electrical switching apparatus of claim 14 wherein a first insulating casing is disposed about said first permanent magnet; and wherein a second insulating casing is disposed about said second permanent magnet.

16. The bi-directional, direct current electrical switching apparatus of claim 14 wherein a magnetic field between said first and second permanent magnets reverses direction at a volume of space distal from the first and second arc chambers, beyond the end portion of said third ferromagnetic member and beyond the closed position of said separable contacts; and wherein said first and second contoured gassing walls are structured to block said volume of space.

17. The bi-directional, direct current electrical switching apparatus of claim 14 wherein said first contoured gassing wall is coupled to a first insulating casing about said first permanent magnet; and wherein said second contoured gassing wall is coupled to a second insulating casing about said second permanent magnet.

18. The bi-directional, direct current electrical switching apparatus of claim 17 wherein said movable contact arm comprises a third insulating casing disposed about said movable contact arm.

19. The bi-directional, direct current electrical switching apparatus of claim 14 wherein each of said first and second contoured gassing walls has a curved portion that approximates the path of motion.

20. The bi-directional, direct current electrical switching apparatus of claim 19 wherein the curved portion is a first curve portion; and wherein the end portion of said third ferromagnetic member has a second curved portion that approximates the path of motion.

* * * * *